US008470761B2

(12) United States Patent
Calvert

(10) Patent No.: US 8,470,761 B2
(45) Date of Patent: Jun. 25, 2013

(54) LAUNDRY FORMULATIONS AND METHOD OF CLEANING

(75) Inventor: Michael E. Calvert, Easington Village (GB)

(73) Assignee: Croda International PLC, Goole, East Yorkshire (GB)

( * ) Notice: Subject to any disclaimer, the term of this patent is extended or adjusted under 35 U.S.C. 154(b) by 244 days.

(21) Appl. No.: 12/734,322

(22) PCT Filed: Oct. 21, 2008

(86) PCT No.: PCT/GB2008/003569

§ 371 (c)(1),
(2), (4) Date: Jul. 8, 2010

(87) PCT Pub. No.: WO2009/053686

PCT Pub. Date: Apr. 30, 2009

(65) Prior Publication Data

US 2010/0275382 A1 Nov. 4, 2010

(30) Foreign Application Priority Data

Oct. 25, 2007 (GB) ..... 0720962.0
Aug. 26, 2008 (GB) ..... 0815504.6

(51) Int. Cl.
*C11D 1/83* (2006.01)

(52) U.S. Cl.
USPC ..... 510/499; 510/500; 510/501

(58) Field of Classification Search
USPC ..... 510/499, 500, 501
See application file for complete search history.

(56) References Cited

U.S. PATENT DOCUMENTS

| | | | | |
|---|---|---|---|---|
| 5,476,597 | A * | 12/1995 | Sakata et al. | 510/522 |
| 5,747,108 | A | 5/1998 | Farooq et al. | |
| 6,506,716 | B1 | 1/2003 | Delplancke et al. | |
| 6,828,292 | B2 * | 12/2004 | Noyes et al. | 510/287 |
| 2005/0090423 | A1 * | 4/2005 | Ushio et al. | 510/515 |

FOREIGN PATENT DOCUMENTS

| | | |
|---|---|---|
| WO | WO 97/12021 | 4/1997 |
| WO | WO 02/22772 | 3/2002 |

OTHER PUBLICATIONS

International Search Report dated Mar. 17, 2009 for PCT/GB2008/003569.

* cited by examiner

*Primary Examiner* — John Hardee
(74) *Attorney, Agent, or Firm* — Jones Day

(57) ABSTRACT

Textiles are simultaneously cleaned and conditioned in aqueous laundry cleaning using detergent surfactant and non-ionic fatty amino-amide/ester fabric conditioner. The conditioner particularly includes compound(s) of the formulae (IIa), to (IId), (III), (IV) and/or (V): Formula $R^1$—CO—NH—$(CH_2)_n$—$NR^2$—$(CH_2)_n$—$O_2C$—$R^1$ and Formula $R^1$—CO—NH—$(CH_2)_n$—$NR_2$—$(CH_2)_n$—NHCO—$R^1$. Formula (IIc) or formula (IId). $R^1$, $R^2$ and n are defined with $R^1$ and/or $R^2$ including fatty hydrocarbyl; formula $[R^4—(CH_2)_p]_3$—N. $R^4$ is HO—, or $R^8CO_2$—; $R^6$ is hydrocarbyl (including fatty hydrocarbyl); and p is 2 to 6; formula $R^7$—N-$[(AO)_m—R^8]_2$. $R^7$, $R^8$, AO and m are defined with $R^7$ and/or $R^8$ including fatty hydrocarbyl; formula $(R^1—CONH)_q—R^{10}$. $R^1$ as in formulae (Ia) or (Ib), $R^{10}$ is polyalkyleneimine after removal of q primary amino groups; and q is at least 1, desirably at least 2. Detergent formulations may include builders, and may be formulated to be transparent particularly using substituent branched and/or unsaturated fatty hydrocarbyl non-ionic fabric conditioners.

31 Claims, No Drawings

LAUNDRY FORMULATIONS AND METHOD OF CLEANING

CROSS REFERENCE TO RELATED APPLICATION

This application is the National Phase application of International Application No. PCT/GB2008/003569, filed Oct. 21, 2008, which designates the United States and was published in English. The foregoing related application, in its entirety, is incorporated herein by reference.

This invention relates to the laundry cleaning of clothes i.e. in an aqueous medium, in particular using a combination of detergent surfactant and conditioning agent in a wash cycle to achieve simultaneous washing and fabric conditioning.

It is well known and widely used in domestic or industrial laundry processes to include (at least) two stages: a wash cycle and a rinse cycle, and where desired for a fabric conditioner to be included in the rinse cycle. Conventional fabric conditioners for rinse cycle use are typically quaternary ammonium compounds (present as salts) including a fatty chain. The usual explanation of their action is that the quaternary ammonium group acts to provide substantivity to the fibres of the fabric being rinsed and the fatty chain acts to lubricate the fibres, reducing fibre to fibre friction, to give the desired conditioning effect. Although adding fabric conditioners in the rinse cycle can be effective, it is recognised as desirable to provide improved convenience, particularly in domestic laundry cleaning, by using wash products that combine detergency and fabric conditioning in the wash cycle of the cleaning process, without requiring a separate addition of specialised fabric conditioner in the rinse cycle. Unfortunately, it has proved difficult to formulate detergent surfactant and fabric conditioning agent in a single stable product, not least because laundry detergent formulations commonly include anionic detergent surfactants which are not compatible (cannot be stably co-formulated or stably used in aqueous systems) with conventional quaternary ammonium fabric conditioners.

The existing product, "Bold 2 in 1" from Proctor & Gamble, seeks to provide such an "all in one" or "2 in 1" combination of effects. The product range includes aqueous liquid, packaged liquid (usually in unit dose form) ("liquitab"), powder and tablet versions which include a largely conventional detergent surfactant package including non-ionic and anionic detergent surfactants in combination with clay which absorbs sebum from the laundry being cleaned to increase the fabric conditioning effect, usually in combination with a flocculating polymer to enhance deposition of the clay onto the clothes, or silicone based fabric conditioners. According to Proctor & Gamble (on the tide.com website), a more recent product, "Tide with a touch of Downy", uses in liquid versions a quaternary ammonium fabric conditioner which is compatible with the detergents used in the liquid product and in solid versions a bentonite clay conditioner. Both of these approaches are acknowledged as giving less effective fabric conditioning than fabric conditioners applied in a separate rinse cycle. These products represent a step in the direction of "all in one" or "2 in 1" combination products, but generally rely on relatively less effective fabric conditioners.

The present invention is based on our discovery that certain non-ionic fatty amino-amide/ester fabric conditioners, some of which have been used under acidic conditions in industrial fabric conditioning i.e. during textile manufacture, can be used simultaneously with detergent surfactants in water based laundry cleaning to give both good cleaning and satisfactory fabric conditioning.

Accordingly the present invention provides:

i a method of cleaning and conditioning textiles which comprises a wash cycle in which the textiles are contacted with water, at least one detergent surfactant and at least one non-ionic fatty amino-amide/ester fabric conditioner, maintaining the contact so that the textiles are washed and conditioned, and, optionally but desirably, subsequently subjecting the textiles to one or more, but usually one, rinse cycle(s);

ii a method of cleaning and conditioning textiles which comprises a wash cycle in which the textiles are contacted with water and a preformulated composition containing both at least one detergent surfactant and at least one non-ionic fatty amino-amide/ester fabric conditioner, maintaining the contact so that the textiles are washed and conditioned, and, optionally but desirably, subsequently subjecting the textiles to one or more, but usually one, rinse cycle(s);

iii a laundry detergent and fabric conditioning formulation which comprises:

a detergent surfactant, desirably including at least one non-ionic and at least one anionic detergent surfactant;

b at least one non-ionic fatty amino-amide/ester fabric conditioner;

c at least one detergency builder.

The requirements for a practical conditioner combined in a laundry formulation (for brevity referred to as a "2-in-1" laundry formulation) include substantivity to the fabric under laundry conditions, particularly the moderately alkaline conditions typically used in laundry cleaning, the provision of conditioning effects on the fabrics being cleaned and compatibility with the detergent surfactants used in laundry formulations. Compatibility with detergent surfactants has two aspects: generally, compatibility in the laundry wash environment is required and additionally in liquid detergent formulations compatibility in the detergent formulation is needed (not generally a problem with solid powder or tablet formulations). Conventional fabric conditioners intended for separate application after the main wash cycle of a laundry process are typically long chain alkyl quaternary ammonium salts—the ammonium group aiding in substantivity with the long alkyl group acting to lubricate the fibres to give conditioning. Unfortunately, such materials are typically incompatible with laundry formulations because they tend to form insoluble salts with anionic detergent surfactants of laundry detergent formulations and this can happen in the aqueous laundry cleaning medium or in liquid detergent formulations. As is noted above, other types of conditioner such as clays and silicones are generally less good as fabric conditioners. Where acidic conditions of application can be used e.g. in textile manufacture, then non-quaternary amines can be used because the acidic conditions result in protonation of the amine to generate a positively charged species which is more substantive to textiles than the unprotonated material. An example of such materials is Croda Chemicals Europe Ltd's ("Croda") product Edunine V, which is provided as the acetate of an amino fatty acid amide, typically of stearic acid and is applied to textiles as a conditioner during fabric manufacture typically at a pH of about 4.

In the present invention, the fabric conditioner component of the formulation used is a fatty amino-amide/ester material, which is non-ionic to avoid compatibility difficulties with anionic detergent surfactants. Typically the non-ionic fatty amino-amide/ester fabric conditioner component will include at least one ester and/or amido group; at least one amino group, usually a secondary, or tertiary amino group and/or at least one imidazolyl group; and at least one fatty residue. The amino group(s) and the fatty residue(s) will typically be linked by alkenyl or (poly)alkyleneoxy linking groups and usually amido or ester functional groups. The non-ionic fatty amino-amide/ester conditioner component may be referred to using the shorthand phrase "non-ionic fabric conditioner".

One class of non-ionic fatty amino-amide/ester conditioner component is esters and/or amides of fatty acids and this type of non-ionic conditioner will generally include one or both of the following molecular groupings:

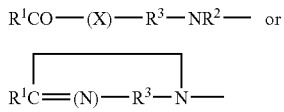

(Ia)

(Ib)

where $R^1$ is a fatty hydrocarbyl, particularly a $C_9$ to $C_{23}$, group;

$R^2$ is H or a hydrocarbyl, particularly a $C_1$ to $C_{24}$, group;

X is —O— or —NH—; and each $R^3$ is independently a $C_2$ to $C_6$ alkylene group, particularly of the formula $—(CH_2)_n—$ where each n is independently from 2 to 6, usually 2 or 3, generally 2.

The group (Ib) is an imidazolyl grouping which can be derived from a grouping of the formula (Ia) where at least one X and $—NR^2—$ are —NH—, by dehydration (see below on synthesis).

The amino group containing grouping will typically be linked to a hydrocarbyl group which may be a short chain, particularly $C_1$ to $C_6$, more usually $C_1$ to $C_4$, typically methyl or ethyl, hydrocarbyl, typically alkyl group, or long chain i.e. fatty hydrocarbyl, particularly alkyl or alkenyl, directly bound to the amino group; or a hydrocarbyl group indirectly bound to the amino group through one or more groups $—R^3—(X)—$ where each X and each $R^3$ are independently as defined above, and where the terminating hydrocarbyl group is linked in by a direct bond to the end group X of by a group —CO—. In particular the linking group and terminating group together form a group of the formula: $—R^3—(X)—COR^1$ where $R^1$, X and $R^3$ are independently as defined above.

Particularly desirable compounds of this type for use a conditioners are of the formula (II):

$$R^1—CO—(X)—R^3—NR^2—R^3—(X)—OC—R^1 \quad \text{(II)}$$

where one group $R^1$ is a hydrocarbyl, desirably a fatty hydrocarbyl group and the other is H or a hydrocarbyl, desirably a fatty hydrocarbyl group;

$R^2$ is H or a hydrocarbyl, particularly a $C_1$ to $C_{24}$, group;

each X is independently —O— or —NH—; and each $R^3$ is independently a $C_2$ to $C_6$ alkylene group, particularly of the formula $—(CH_2)_n—$ where each n is independently from 2 to 6, usually 2 or 3, generally 2;

wherein at least one group $R^1$ or $R^2$ is or includes a fatty hydrocarbyl group.

Among compounds of the formula (II) we have found that (asymmetric) compounds in which one group X is $—NR^2—$ and the other is —O— seem to be better at providing fabric conditioning than (symmetric) compounds where both X groups are the same group $—NR^2—$; however, we have also found that such asymmetric compounds are less easy to formulate into stable liquid laundry detergent formulations than symmetric compounds, but that combinations of symmetric and the asymmetric compounds can provide both good stability in formulation and fabric conditioning. Accordingly, the invention particularly provides for the use of a combination of compounds of the formulae (IIa) and (IIb):

$$R^1—CO—NH—R^3—NR^2—R^3—O_2C—R^1 \quad \text{(IIa)}$$

$$R^1—CO—NH—R^3—NR^2—R^3—NHCO—R^1 \quad \text{(IIb)}$$

where each $R^1$, each $R^2$ and each $R^3$ is independently as defined above for formula (II).

In compounds of the formulae (IIa) and (IIb), where the group $—NR^2—$ is —NH—, typical synthesis reactions (see further below) are likely to lead to the formation of cyclic groups, such as, where $R^3$ is an ethylene group, imidazolyl groups, and the practical materials will generally include the corresponding cyclic compounds:

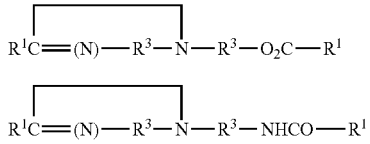

(IIc)

(IId)

where each $R^1$, each $R^2$ and each $R^3$ is independently as defined above for formula (IIa) and/or (IIb).

When the group $R^3$ is of the formula $(CH_2)_n—$, index n, representing the length of the alkylene linking group; is typically from 2 to 6, though usually 2 or 3 and desirably 2.

This type of conditioner compound (or mixture of compounds) can also be considered as the reaction products of a precursor aminoamine and/or an aminoalcohol and one or more carboxylic acids and the invention accordingly includes the methods and formulations of the invention where the non-ionic conditioner is the reaction product of an aminoamine and/or an aminoalcohol and one or more carboxylic acids, usually including at least one $C_{10}$ to $C_{24}$ fatty acid(s). The molar ratio of acid to amine will usually be in the range of 1:1 to 3:1, particularly 1:1 to 2:1.

This broad class of non-ionic fatty amino-amide/ester conditioner components also includes esters of tri-hydroxy amino compounds, such as triethanolamine, and in particularly includes compounds of the general formula (III):

$$[R^4\text{-}R^5]_3—N \quad \text{(III)}$$

where each group $R^4$ is independently HO—, or $R^6CO_2—$; where $R^6$ is hydrocarbyl, particularly a $C_1$ to $C_{24}$, group, with the molecule including at least one and desirably two groups $R^6$ being fatty hydrocarbyl, particularly $C_9$ to $C_{23}$, group(s); and each $R^5$ is independently a $C_2$ to $C_6$ alkylene group, particularly of the formula $—(CH_2)_p—$ where each p is independently from 2 to 6, usually 2 or 3 and generally 2.

This type of conditioner compound (or mixture of compounds) can also be considered as the reaction products of a precursor tri-hydroxy amino compound and one or more carboxylic acids and the invention accordingly includes the methods and formulations of the invention where the non-ionic conditioner is the reaction product of a tri-hydroxy amino compound and one or more carboxylic acids, usually including at least one $C_{10}$ to $C_{24}$ fatty acid(s). The molar ratio of acid to amine will usually be in the range of 1:1 to 3:1, particularly 1:1 to 2:1.

Another group of compounds that can be used as non-ionic fatty amino-amide/ester fabric conditioner components are esters of alkoxylated fatty amines, particularly of the formula (IV):

$$R^7—N-[(AO)_m—R^8]_2 \quad (IV)$$

where $R^7$ is a hydrocarbyl, particularly a fatty hydrocarbyl, particularly alkyl, group;

AO is an alkyleneoxy, particularly ethyleneoxy, group;

m is an average value of 1 to 20 (and being an average may be non-integral); and one group $R^8$ is a group $COR^9$ and the other is H or a group $COR^9$, where each group $R^9$ is independently a $C_1$ to $C_{23}$ hydrocarbyl group;

wherein at least one group $R^7$ or $R^9$ is or includes a fatty hydrocarbyl group.

The alkyleneoxy group, AO, is usually a $C_2$ to $C_4$, more usually $C_2$ or $C_3$, alkyleneoxy and is desirably ethyleneoxy, though a minor proportion e.g. up to 25% by weight, may be propyleneoxy, which may be included in block or random copolymer chains. The indices m represent the chain length of the (poly)alkyleneoxy chains with usually the chains not being particularly long e.g. with m up to 10, and more usually from 1 to 5 and particularly 1 or 2.

A variation within formula (IV) compounds can also be used as non-ionic fatty amino-amide/ester fabric conditioner components are esters of short chain alkoxylated amines which can also be described as short chain alkyl diethanolamines or their alkoxylated, usually ethoxylated, derivatives, particularly of the formula (IVa):

$$R^{7'}—N-[(AO')_{m'}—R^{8'}]_2 \quad (IVa)$$

where $R^{7'}$ is a short chain alkyl group, particularly a $C_1$ to $C_{10}$ alkyl, more particularly a $C_1$ to $C_6$ alkyl, usually a methyl or ethyl, group;

each AO' is a group AO as defined for formula (IV);

each m' is independently an average value of 1 to 5 (and being an average may be non-integral), though usually each m' is 1; and one group $R^{8'}$ is a group $COR^{9'}$ and the other is H or a group $COR^{9'}$, though usually both groups $R^{8'}$ are groups $COR^{9'}$, where each group $R^{9'}$ is independently a $C_9$ to $C_{23}$ hydrocarbyl group.

Non-ionic fabric conditioner compounds of the formula (IVa) have the advantage that they are capable of providing transparent (rather than opaque or cloudy) formulated detergents.

This type of conditioner compound (or mixture of compounds) can also be considered as the reaction products of an alkoxylated amine and one or more carboxylic acids and the invention accordingly includes the methods and formulations of the invention where the non-ionic conditioner is the reaction product of an alkoxylated amine and at least one carboxylic acid, which may include at least one $C_{10}$ to $C_{24}$ fatty acid(s). The molar ratio of acid to amine will usually be in the range of 1:1 to 2:1.

A further group of compounds that can be used as non-ionic fatty amino-amide/ester fabric conditioner components are fatty amides of alkylenamines, commonly described as oligo- or polyalkyleneimines. Non-ionic fabric conditioner compounds based on oligo- or polyalkylene-imines can be represented by the general formula (V):

$$(R^1—CONH)_q—R^{10} \quad (V)$$

where $R^1$ is as defined for formula (I);

$R^{10}$ is the residue of a polyalkyleneimine after removal of q primary amino groups; and q is at least 1, desirably at least 2.

Structurally, the precursor oligo- or poly-alkyleneimines may be considered as two groups: linear oligo-alkyleneimines and poly-alkyleneimines.

Linear oligoalkyleneimines typically have from 2 to 8, more usually 3 to 6 and particularly 3 to 5, alkylene groups with amino group between the alkylene groups and at the ends of the chain. The two terminal amino groups are primary and the remainder (1 fewer than the number of alkylene groups) is/are secondary. The alkylene groups can be $C_2$ to $C_6$, usually $C_2$ to $C_4$, more usually $C_2$ or $C_3$, particularly ethylene ($—CH_2CH_2—$), groups. Examples include: triethylene tetramine, tetraethylene pentamine and pentaethylene hexamine. The conditioner compounds based on the shorter oligoalkyleneimines—with two alkylene groups and three amino groups—are also compounds of the formula (IIb) above.

Within the general formula (V), non-ionic fabric conditioner compounds based on linear oligo-alkyleneimines can be represented by the general formula (Va):

$$R^1CO—(NHR^{11})_r—NHCOR^1 \quad (Va)$$

where each $R^1$ is independently as defined in formula (Ia) or (Ib);

$R^{11}$ is an alkylene group, particularly a $C_2$ to $C_6$ alkylene group, desirably a $C_2$ to $C_6$ polymethylene group, and more particularly a $—CH_2CH_2—$ group r is from 2 to 7, particularly 3 or 4.

Compounds of the formula (Va) where r is 2 and $R^{11}$ is a $C_2$ to $C_6$ polymethylene group are also compounds of the formula (IIb) above.

Polyalkylenimines are generally higher molecular weight materials (than the linear oligo-alkylenimines), typically having at least 5 more usually at least 10, and up to 500, but usually not more than 400 repeat units, commonly including chain branching. The repeat units are typically nominally ethylenimine ($—CH_2CH_2—N$), and the polymers are thus polyethyleneimines (PEIs). Where the polymer chains are branched, the amino groups in PEI will include a combination of primary, secondary and tertiary groups. PEIs are commonly made by (net) ring opening polymerisations of aziridine (azacyclopropane or ethylene imine) and the synthetic reaction can give linear and branched chain segments. The extent of branching depends on the synthetic reaction conditions and product molecular weight with higher molecular weight products generally including more branching. Branching affects the relative proportions of primary, secondary and tertiary nitrogens so that at relatively low molecular weight e.g. about 300, the ratio is typically about 45:35:20; at higher molecular weights the ratio is more equal, such that at molecular weights much above 500 typical ratios approximate 1:1:1. Overall PEIs have on average more than 2 primary amino groups per molecule, though some groups may be strongly sterically hindered, and this may influence the practical ratio of $NH_2$ groups to fatty groups in the non-ionic conditioner produced from them. The average molecular weight of polyalkylenimine precursors will usually be from 100 to 20000, more usually 100 to 1000, particularly 100 to 500 corresponding to an average of about 2.5 to 465, 2.5 to 23 and 2.5 to 12 repeat units respectively.

Within the formula (V), non-ionic fabric conditioner compounds based on, generally branched, polyalkylenimines can be represented by the general formula (Vb):

$$(R^1CONH)_s—R^{12} \quad (Vb)$$

where each R1 is independently as defined in formula (Ia) or (Ib);

s is at least 1, usually at least 2, and up to typically 7, usually 2 to 4, particularly (on average) about 2 to about 3; and $R^{12}$ is the residue of a branched polyalkyleneimine after removal of s primary amino groups.

The precursor linear oligoalkyleneimines and some chains in precursor polyalkylenimines terminate with linear repeat units and it is possible that cyclic groups, imidazoline groups for oligo- and poly-ethylenimine, may be formed analogous to those in compounds of the general formulae (Ib), (IIc) and (IId) above. Such "terminal" imidazoline groups will typically be of the formula (Vc):

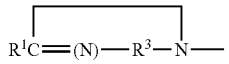

(Vc)

where $R^1$ is as defined in formula V, and $R^3$ is a $C_2$ to $C_6$ alkylene group, particularly of the formula $—(CH_2)_n—$ where each n is independently from 2 to 6, usually 2 or 3, generally 2.

Such, oligo- and poly-alkylenimine based non-ionic fabric conditioners will typically include an average of at least 1 fatty acid residue per molecule and, particularly where linear oligoalkylenimines are used, more commonly an average of from 1.5 to 2 fatty acid residues per molecule. Where the non-ionic fabric conditioners are based on branched polyalkylenimines a higher proportion of fatty acid residues is possible (because branched polyalkylenimines have more than 2 terminal primary amino-groups—though not all may be available because of steric hindrance) and may be used. However our work indicates that about 2 fatty acid residues per molecule is a beneficial ratio and it is unlikely that more than 3 fatty acid residues per molecule will be used.

The non-ionic fatty amino-amide/ester fabric conditioner includes hydrocarbyl group(s) including at least one fatty hydrocarbyl group. The term "hydrocarbyl" generally refers to $C_1$ to $C_{24}$ hydrocarbyl groups. Typically, the fatty hydrocarbyl group(s) may either be present as a substituent on an amino-nitrogen atom, as in the groups $R^2$ in formulae (Ia) or (Ib), (IIa) to (IId), (III), or $R^7$ or $R^{7'}$ in formulae (IV) and (Va) respectively, or as part of a fatty acyl group in an ester or amide, as in the groups $—COR^1$ in formulae (Ia) or (Ib), (IIa to IId) and (V), (Va) and (Vb); $R^6CO_2—$ in the group(s) $R^4$ in formula (III); or $COR^9$ in the group(s) $R^8$ in formula (IV). Where the fatty hydrocarbyl residue is in an amino group it will usually be saturated and straight chain, where it is part of a fatty acid residue it may be linear or branched and/or saturated or unsaturated. We have found that using, or including suitable proportions of, branched and or unsaturated fatty hydrocarbyl groups, particularly in fatty acyl residues, can give or contribute to providing transparent detergent formulations. These hydrocarbyl or fatty acyl groups will generally be $C_{10}$ to $C_{24}$, more usually $C_{12}$ to $C_{24}$, desirably $C_{14}$ to $C_{22}$, and particularly $C_{16}$ to $C_{22}$, groups (with each group $R^1$, $R^6$ and $R^9$ thus containing 1 fewer carbon atom) and the phrase "fatty hydrocarbyl" should be interpreted accordingly. Where the fatty hydrocarbyl group is part of a fatty acyl residue, suitable fatty acids to provide this residue include stearic, iso-stearic (commercially available as a mixture of various linear and (mainly) branched chain $C_{14}$ to $C_{22}$ carboxylic acids averaging about $C_{18}$), oleic, linoleic, eliadic, erucic and behenic acids.

The compounds used in the invention as non-ionic fatty amino-amide/ester fabric conditioner include at least one fatty group, but desirably will have two such groups, particularly as described above. Other hydrocarbyl group(s) will thus generally be relatively short chain groups typically from $C_1$ to $C_7$ groups (which in acyl groups corresponding to residues of $C_2$ to $C_8$ acids).

The non-ionic fatty amino-amide/ester fabric conditioners used in this invention can be made by methods that are generally known in the art—indeed many of these materials are themselves known. Compounds of the general formulae (II) and (III) can be made by reacting a precursor triamine, diamino-alcohol, amino-diol or amino-triol, as the case may be, with a fatty acid if desired with an esterification and/or amidation catalyst typically at elevated temperature and/or reduced pressure to remove water of condensation. Where the starting material amine includes a group: $—(NH)—R^3—NH—$, particularly $—(NH)—(CH_2)_n—NH—$, the initial reaction with the carboxylic acid will give rise to an amido amine group: $—OC—(NH)—R^3—NH—$, particularly $—OC—(NH)—(CH_2)_n—NH—$, which under typical reaction conditions may undergo a further condensation reaction to form a heterocyclic ring including the two nitrogen atoms, where n=2 this will be an imidazolyl group, i.e. to the formation of compounds of the general formulae (IIc) or (IId).

Compounds of the general formulae (IV) above can be made by reacting a precursor amine, typically a fatty amine, alkoxylate, usually ethoxylate, with a carboxylic acid under esterification conditions similar to those described above for compounds of the general formulae (II) and (III).

Compounds of the general formula (V) above can be made by reacting a precursor polyalkylenimine with a carboxylic acid under amidation conditions similar to those described above for compounds of the general formulae (II) and (III).

For any of these approaches the relative proportions of amines and carboxylic acid are indicated above. Typically the esterification/amidation reactions are carried out at moderately elevated temperatures to remove water of reaction in the gas phase and suitable temperatures are typically in the range 120 to 250° C., more usually 130 to 200° C. and particularly 140 to 180° C. e.g. from 150 to 160° C. The reaction may be carried out uncatalysed or using a catalyst e.g. an acidic catalyst such as pTSA. The reaction pressure is typically ambient pressure or, especially if it is desired to reduce the thermal exposure of the products, under moderate vacuum e.g. at sub-ambient pressures ranging down to 50 mBar, particularly between 50 and 250 e.g. about 100 mBar to facilitate removal of water of reaction. Particularly where the non-ionic fatty amino-amide/ester fabric conditioner is a mixture of fabric conditioning compounds, the corresponding esterification/amidation reaction starting material may be a mixture of compounds e.g. a 1:1 mixture of diethylenetriamine and 2-hydroxyethylethylenediamine may be reacted with a fatty acid to produce the mixed non-ionic fatty amino-amide/ester fabric conditioner. The esterification/amidation reaction will typically be run to reduce the acid value of the product to less than 20, more usually less than 10 and commonly less than 5 e.g. less than 3, $mg(KOH).g^{-1}$ (measured using American Oil Chemists Society (AOCS) methods Te 1a-64 and Da 14-48).

For compounds including groups of the formula (Ia), (Ib), (IIa) to (IId) and (III) the synthetic starting materials include amino compounds particularly triamines such as diethylenetriamine, diamino-alcohols such as N-(2-hydroxyethyl)ethylene diamine (aminoethylethanolamine), amino-diols such as diethanolamine or ethyldiethanolamine and amino-triols such as triethanolamine.

For esters of alkoxylated amines, particularly of the formula (IV), the synthetic starting materials are alkoxylated, particularly ethoxylated, amines, particularly fatty amines. These can be made by direct alkoxylation, particularly ethoxylation, (usually with a catalyst) of the, usually fatty, amine. The extent of alkoxylation is usually modest and where in formula (IV) both indices m=1 there is overlap between formula (IV) and the formulae (II).

For compounds of the formula (V), the synthetic starting materials are polyalkylenimines.

The amount of the non-ionic conditioner included in the detergent formulations of and used in the method of the invention is generally from 0.2 to 10%, more usually from 0.5 to 7%, and desirably from 0.75 to 4%, by weight of the overall formulation.

The term detergent is commonly used to refer both to an overall laundry formulation and to individual cleaning surfactant components. Accordingly, for clarity we use the phrase "detergent surfactant" to refer to individual cleaning surfactant components and the phrase "detergent formulation" to refer to combinations of detergent surfactant(s) with other formulation components including overall laundry formulations.

The detergent surfactant(s) in the laundry formulation will typically be chosen from non-ionic and anionic detergent surfactants and in particular combinations of non-ionic and anionic detergent surfactants.

Suitable non-ionic detergent surfactants include those based on alkylene oxide derivatives such as polyalkyleneoxy derivatives of alcohols (alkanols), amines, alkanolamides and alkylphenols and amine oxide based detergent surfactants.

Suitable alkanols may contain 6 to 20 carbon atoms, more usually 8 to 18 and particularly 10 to 16 carbon atoms. The alcohol is preferably a primary or secondary alkanol having a linear or mono branched alkyl group.

Suitable alkanolamides are mono- or di-alkanol amides e.g. a mono- or diethanolamide, particularly of a $C_6$ to $C_{30}$, more usually a $C_{10}$ to $C_{20}$, alkanoic acid, e.g. coconut fatty acids, tallow fatty acids or stearic acid.

Suitable alkyl phenols include those having straight chain or branched chain $C_6$ to $C_{20}$ alkyl groups, particularly those where the alkyl group is para- to the phenolic OH group e.g. para-nonyl phenol and para-dodecylphenol.

In general such alkylene oxide derivatives will have 1 to 20, more usually 2 to 10 and particularly 3 to 8, alkylene oxide units per mole of detergent surfactant and are desirably ethylene oxide units although a minor number of propylene oxide or butylene oxide units may also be included. The (poly)-alkyleneoxy chains are generally made by polymerisation and the resulting chain lengths are expressed as average numbers of repeat units and this number ma be non-integral.

Another type of alkoxylate non-ionic detergent surfactant are block copolymers of ethylene oxide with propylene oxide and/or butylene oxide. The copolymer typically comprises a block of propylene and/or butylene oxide units on to which is grafted the ethylene oxide. The block of propylene and/or butylene oxide units typically has 20 to 40, particularly about 30, propylene oxide and/or butylene oxide units, such units and 20 to 30, particularly about 26, ethylene oxide units.

Suitable non-ionic amine oxide detergent surfactants have a $C_{10}$ to $C_{18}$, particularly a $C_{12}$ to $C_{16}$, alkyl group and 2 other groups each individually a $C_1$ to $C_3$ alkyl or hydroxyalkyl group.

Blends or combinations of two or more non-ionic detergent surfactants of similar or different types may be used if desired.

The amount of non-ionic detergent surfactant included in the detergent formulations of and used in the invention is generally from 0.1 to 50%, more usually from 0.2 to 40%, and desirably from 0.5 to 25%, by weight of the overall formulation.

Suitable anionic detergent surfactants may be included if desired. Such anionic surfactants may be of known type for example natural or synthetic soaps, alkylbenzene or olefin sulphonates, alcohol sulphates (also known as primary alkyl sulphates), or alcohol alkoxylate sulphates.

The amount of anionic detergent surfactant included in the detergent formulations of and used in the invention is generally from 0.1 to 50%, more usually from 0.2 to 40%, and desirably from 0.5 to 25%, by weight of the overall formulation.

The total amount of detergent surfactant included in the detergent formulations of and used in the invention is generally from 10 to 60%, more usually from 15 to 30%, by weight of the overall formulation, and may vary depending on the type of formulation (see below for further details).

Builders are included in laundry detergent formulations to improve detergent surfactant cleaning performance, mainly by preferentially reacting with alkaline earth metals, particularly calcium and/or magnesium, typically present as 2+ cations e.g. $Mg^{2+}$ and/or $Ca^{2+}$, in the water to prevent interference with detergent surfactant cleaning performance. Typical builders include inorganic compounds such as alkali metal, usually sodium and/or potassium, more usually sodium, salts such as phosphates, e.g. trisodium phosphate; or condensed phosphates e.g. tetrasodium pyrophosphate, sodium hexametaphosphate and sodium tripolyphosphate; carbonates e.g. sodium carbonate, bicarbonate and/or sesquicarbonate; silicates e.g. sodium meta-silicate; minerals that adsorb or ion exchange the alkaline earth metal ions particularly zeolites [those skilled in the art will appreciate that mineral builders such as zeolites have substantial ion exchange capacity which enable them to absorb alkali metal ions from the aqueous laundry medium and differ from conditioner clays which are layer minerals (with generally limited ion exchange capacity) but which can absorb organic materials such as sebum and carry it onto clothes as described above]; and organic compounds such as nitrilotriacetic acid and its water soluble salts; sodium carboxymethylcellulose; and hydroxycarboxylic acids having 2 to 6 —COOH groups and 1 to 5 —OH groups e.g. citric and/or tartaric acid or their water soluble salts e.g. sodium citrate.

The amount of builder included in the detergent formulations of and used in the invention is generally from 2 to 90%, more usually from 2 to 60%, and desirably from 2 to 45%, by weight of the overall formulation.

The 2-in-1 laundry detergent formulations of and used in the invention may be formulated as liquids, particularly aqueous liquids, which may be packaged conventionally in bottle or similar containers or in single dosage forms, particularly in water soluble or water dispersible film packaging usually provided to the end user in unit dose form (commonly called "liquitabs"); or as solids, typically either as powders or as tablets, usually each containing an amount of the detergent formulation suitable for a single wash.

Aqueous liquid detergent formulations of and used in the invention will typically have formulations including the following components (apart from the non-ionic conditioner):

detergent surfactants—usually a combination of non-ionic e.g. alcohol alkoxylates, and anionic surfactants e.g.

alkali metal linear alkyl benzene sulphonates and/or alcohol sulphates, optionally, but commonly, including a minor proportion of fatty acid soap(s)—typically the overall level of detergent surfactants is in the range 15 to 50%, more usually 20 to 50%, desirably 20 to 40%, by weight of the composition; in this commonly from generally 0.5 to 35%, more usually 0.5 to 30% and desirably 0.5 to 25%, by weight is non-ionic surfactant; and generally 0.5 to 35%, more usually 0.5 to 30% and desirably 0.5 to 25%, by weight is anionic surfactant, which may include fatty acid soaps;

builder—which can be phosphate, including phosphonate, zeolite, hydroxy acid, or alkali metal hydroxide, carbonate or silicate or a combination of two or more of these types e.g. zeolite and alkali metal, particularly sodium, carbonate, but it is not unusual and may be desirable to use wholly water soluble builders; with a typical overall builder level in the range 0.5 to 10%, more usually 1 to 8%, and desirably 2 to 6%, by weight of the composition;

Minor components could typically include fluoresce(s) (optical brighteners), antifoam(s), bleach(es), bleach activator(s) enzyme(s), fragrance(s), antiredeposition agent(s) (CMC), opacifier(s), preservative(s) and thickener(s). These are used at conventional levels (which will depend on the particular component) but are each usually not more than 5% by weight.

Packaged liquids ("liquitab" type), will typically have similar formulations to liquid type detergent formulations.

The ranges (in % by weight) in the following table are representative of typical such aqueous liquid, including packaged liquid, formulations (other than minor components):

| | general | typical | desirable |
|---|---|---|---|
| Detergent | 15 to 50 | 20 to 50 | 20 to 40 |
| Anionic | 0.5 to 35 | 0.5 to 30 | 0.5 to 25 |
| Non-ionic | 0.5 to 35 | 0.5 to 30 | 0.5 to 25 |
| Builder | 0.5 to 10 | 1 to 8 | 2 to 6 |
| Solvents/dispersants (when present) | | 0.5 to 10 | |
| Fabric Conditioner | 0.2 to 10 | 0.5 to 7 | 0.75 to 4 |
| water | | to 100% | |

Liquid aqueous detergent formulations including the non-ionic fabric conditioners are generally translucent to opaque in appearance. However we have found that when certain non-ionic fabric conditioners are used it is possible to produce transparent detergent/conditioner formulations. In particular, using conditioners which include branched and/or unsaturated hydrocarbyl groups, particularly in fatty acid residues, and/or those based on esters of short chain alkoxylated amines [N-(short chain alkyl) diethanolamines or their alkoxylated, usually ethoxylated, derivatives] e.g. compounds of the formula (IVa) above, particularly short chain, particularly $C_1$ to $C_6$, alkyl diethanolamines, can give transparent formulations with detergents.

The invention accordingly includes the methods of cleaning and conditioning textiles, of the invention, in which the non-ionic fatty amino-amide/ester fabric conditioner is derived from one or more unsaturated and or branched chain fatty acids and/or from one or more short chain alkoxylated amine, particularly $C_1$ to $C_6$, alkyl diethanolamine.

The invention further includes a laundry detergent and fabric conditioning formulation which comprises:

a detergent surfactant, desirably including at least one non-ionic and at least one anionic detergent surfactant;

b at least one non-ionic fatty amino-amide/ester fabric conditioner which is derived from one or more unsaturated and or branched chain fatty acids and/or from one or more short chain alkoxylated amine, particularly $C_1$ to $C_6$, N-alkyl diethanolamine;

c at least one detergency builder.

Solid laundry detergent formulations of and used in the invention will typically have compositions including the following components (apart from the non-ionic conditioner):

detergent surfactants—usually a combination of non-ionic e.g. alcohol alkoxylates, and anionic surfactants e.g. alkali metal linear alkyl benzene sulphonates and/or alcohol sulphates, optionally, but commonly, including a minor proportion of fatty acid soap(s)—typically the overall level of detergent surfactants is in the range 10 to 60%, more usually 12 to 40% and desirably 15 to 30%, by weight of the composition; amounts in the range 10 to 60%, more usually 12 to 25% and desirably 15 to 20%, by weight being typical for standard powders and generally 15 to 60%, more usually 20 to 40% and desirably 20 to 30%, by weight being typical for concentrated powders; and within these totals, commonly from 0.1 to 50%, more usually 0.5 to 25% and desirably 0.5 to 20%, by weight for standard powders and 0.5 to 50%, more usually 0.5 to 35% and desirably 0.5 to 20%, by weight for concentrated powders is non-ionic surfactant(s), which may include fatty acid soaps;

builder—which can be phosphate, zeolite, hydoxy acid, or alkali metal hydoxide, carbonate or silicate, or commonly and frequently desirably, a combination of two or more of these types e.g. zeolite and alkali metal carbonate, particularly sodium carbonate; —typically the overall level of builder(s) is in the range 20 to 80%, more usually 30 to 60%, and desirably 35 to 55%, by weight of the composition, —with ranges for the specific types of builder in a combination formulation of: zeolite—typically 10 to 50%, more usually 15 to 40%, and desirably 20 to 35% and alkali metal salt builder typically 10 to 40%, more usually 12 to 35%, and desirably 10 to 20%, adjusted for whether the overall formulation is a standard or concentrated powder;

Minor components could typically include fluoresce(s) (optical brighteners), antifoam(s), bleach(es), bleach activator(s) enzyme(s), fragrance(s), antiredeposition agent(s) (CMC). These are used at conventional levels (which will depend on the particular component) but are usually not more than 5% by weight each.

The ranges (in % by weight) in the following table are representative of typical such powder formulations (other than minor components):

| | typical | desirable | preferred |
|---|---|---|---|
| standard powder formulations | | | |
| Detergent | 10 to 60 | 12 to 25 | 15 to 20 |
| Anionic | 0.1 to 50 | 0.5 to 25 | 0.5 to 20 |
| Non-ionic | 0.1 to 50 | 0.5 to 25 | 0.5 to 20 |
| Builder | 20 to 80 | 30 to 60 | 35 to 45 |
| of which: | | | |
| mineral (especially) zeolite type | 10 to 40 | 15 to 30 | 20 to 25 |
| alkali metal salt type | 10 to 40 | 12 to 35 | 15 to 20 |
| Fabric Conditioner | 0.2 to 10 | 0.5 to 7 | 0.75 to 4 |

-continued

| | typical | desirable | preferred |
|---|---|---|---|
| concentrated powder formulations | | | |
| Detergent | 15 to 60 | 20 to 40 | 20 to 30 |
| Anionic | 0.1 to 50 | 0.5 to 35 | 0.5 to 20 |
| Non-ionic | 0.1 to 50 | 0.5 to 35 | 0.5 to 20 |
| Builder | 30 to 75 | 30 to 60 | 40 to 55 |
| of which: | | | |
| mineral (especially) type | 20 to 50 | 25 to 40 | 30 to 35 |
| alkali metal salt type | 10 to 25 | 12 to 20 | 10 to 15 |
| Fabric Conditioner | 0.2 to 10 | 0.5 to 7 | 0.75 to 4 |

Solid tablet will typically have similar formulations to concentrated powder type detergent formulations (but may further include binder) and the ranges (in % by weight) in the following table are representative of typical such tablet formulations (other than minor components):

| solid tablet formulations | typical | desirable | preferred |
|---|---|---|---|
| Detergent | 15 to 60 | 20 to 40 | 20 to 30 |
| Anionic | 0.1 to 50 | 0.5 to 35 | 0.5 to 20 |
| Non-ionic | 0.1 to 50 | 0.5 to 35 | 0.5 to 20 |
| Builder | 30 to 75 | 30 to 60 | 40 to 55 |
| of which: | | | |
| mineral (especially) type | 20 to 50 | 25 to 40 | 30 to 35 |
| alkali metal salt type | 10 to 25 | 12 to 20 | 10 to 15 |
| Fabric Conditioner | 0.2 to 10 | 0.5 to 7 | 0.75 to 4 |
| Binder (when present) | 1 to 10 | 2 to 7 | 3 to 5 |

The detergent formulations of and used in the invention may also contain additives conventionally found in such formulations e.g. optical brighteners, antifoam, chelating agents such as ethylene diamine tetra acetic acid, dyes, fragrances or perfumes, enzymes, bleaches, bleach activators, opacifiers, inert fillers e.g. sodium or potassium sulphate, antiredeposition agents such as carboxymethylcellulose (CMC), preservatives and, for liquid formulations, particularly aqueous formulations, thickeners. These are used at conventional levels (which will depend on the particular component) but are usually not more than 5% by weight each.

Laundry cleaning operations of the invention will usually be carried out with the aqueous laundry medium at a temperature of from ambient cold water temperature (typically ca 10° C.) to boiling (ca 100° C.), more particularly at 25 to 60° C. Further the pH of the wash medium will typically be at least 7 and desirably from 8 to 10. Correspondingly the detergent formulations of the invention desirably yield such pH values when dispersed in the laundry aqueous cleaning medium.

The following examples illustrate the invention. All parts and percentages are by weight unless otherwise stated.

Materials

| Fatty acids - all ex Croda | |
|---|---|
| FA1 | commercially available vegetable derived stearic acid; ca 92.5% stearic acid, AV 198 mg(KOH) · g−1, effective MW 282.8 |
| FA2 | commercially available distilled high erucic rape seed fatty acid, AV 178.6 mg(KOH) · g−1, effective MW 313.5 |
| FA3 | behenic acid |
| FA4 | oleic acid |
| FA5 | palmitic acid |

-continued

| Fatty acids - all ex Croda | |
|---|---|
| FA6 | iso-stearic acid |
| FA7 | mixed fatty acids [C16 ca 26%; C18:0 ca 26%; C18:1 ca 37%] - Prifac 5907 |
| FA8 | mixed fatty acids [C16 ca 29%; C18:0 ca 28%; C18:1 ca 30%] - Prifac 5905 |
| FA9 | 'oxidation resistant' oleic acid [C16:0 8.5%; C18:0 6.8%; C18:1 65.5%; C18:2 9.3%; C20:1 7.8%] - selectively hydrogenated rape seed oil top fatty acid |

| Amines | |
|---|---|
| Am1 | N-(2-hydroxyethyl)ethylene diamine [aminoethylethanolamine] ex Sigma Aldrich |
| Am2 | diethylene triamine ex Sigma Aldrich |
| Am3 | triethanolamine ex Sigma Aldrich |
| Am4 | tetraethylpentamine ex Sigma Aldrich |
| Am5 | bis (3-aminopropylamine) ex Sigma Aldrich |
| Am6 | pentaethylene hexamine ex Sigma Aldrich |
| Am7 | N-Methyl diethanolamine ex Sigma Aldrich |
| Am8 | polyalkylenimine MW 300 - SP-003 ex Nippon Shokubai |
| Am9 | polyalkylenimine MW 600 - SP-006 ex Nippon Shokubai |
| Am10 | triethanolamine ex Sigma Aldrich |

Test Methods

Acid Value was measured using American Oil Chemists Society (AOCS) methods Te 1a-64 and Da 14-48 results are given as AV in mg(KOH).$g^{-1}$.

Total Amine value was measured using American Oil Chemists Society (AOCS) method Tf-16-64 results are given as TAV in mg(KOH).$g^{-1}$.

Secondary Amine Value was measured using American Oil Chemists Society (AOCS) method Tf-2b-64 results are given as SAV in mg(KOH).$g^{-1}$.

Saponification Value was measured using American Oil Chemists Society, (AOCS) 1989 methods Cd 3b-76 and 3c-91 results are given as SAP in mg(KOH).$g^{-1}$.

SYNTHESIS EXAMPLES

Synthesis Example SE1

Stearic acid FA1 (873.67 g; 3.08 mol) was heated in a reaction vessel to 90° C. before adding amine Am1 (160.00 g; 1.54 mol) i.e. a molar ratio of stearic acid to amine of 2:1. The mixture was then heated to 160° C. under nitrogen with constant stirring which was continued until the acid value of the material was below 5 mg(KOH).e. After cooling to ambient temperature under nitrogen, the product was recovered as a liquid. The structure of the product was confirmed by quantitative functional analysis (see Table 1 b below) and IR.

Synthesis Examples SE2 to SE29

The products of these Examples were made by the general method described in SE1, but using appropriate materials and amounts. The materials, amounts used and the reaction conditions for Synthesis Examples SE1 to SE29 are summarised in Tables 1a and 2a below.

TABLE 1a

| SE | Synthesis | | | | | | Temp | Time |
|---|---|---|---|---|---|---|---|---|
| | Acid | | | Amine | | | | |
| No | type | g | mol | type | g | mol | (° C.) | (hr) |
| SE1 | FA1 | 873.7 | 3.08 | Am1 | 160.0 | 1.54 | 160 | 8.5 |
| SE2 | FA1 | 872.7 | 3.08 | Am2 | 162.1 | 1.57 | 160 | 4 |
| SE3 | FA1 | 868.8 | 3.07 | Am3 | 230.5 | 1.55 | 160 | 13 |
| SE4 | FA2 | 906.2 | 2.88 | Am2 | 150.9 | 1.46 | 160 | 6.5 |
| SE5 | FA2 | 923.3 | 2.94 | Am1 | 157.1 | 1.51 | 160 | 10.5 |

TABLE 2a

| SE | Synthesis | | | | Temp | Time |
|---|---|---|---|---|---|---|
| | Acid | | Amine | | | |
| No | type | Mol | type | Mol | (° C.) | (hr) |
| SE6 | FA1 | 2 | Am1 + Am2 | 0.5 + 0.5 | 180 | 6.5 |
| SE7 | FA1 | 2 | Am1 + Am2 | 0.5 + 0.5 | 200 | 7.5 |
| SE8 | FA1 | 2.5 | Am1 + Am2 | 0.5 + 0.5 | 180 | 4.5 |
| SE9 | FA4 | 2 | Am1 + Am2 | 0.5 + 0.5 | 180 | 9 |
| SE10 | FA5 | 2 | Am1 + Am2 | 0.5 + 0.5 | 180 | 7.5 |
| SE11 | FA1 | 2 | Am4 | 1 | 180 | 10.5 |
| SE12 | FA1 | 2 | Am5 | 1 | 180 | 6 |
| SE13 | FA1 | 2 | Am6 | 1 | 240 | 13 |
| SE14 | FA1 | 2 | Am1 + Am2 | 0.5 + 0.5 | 240 | 13 |
| SE15 | FA1 | 2 | AM1 | 1 | 200 | 15 |
| SE16 | FA4 | 2 | Am7 | 1 | 240 | 12 |
| SE17 | FA1 | 2 | Am2 | 1 | 200 | 13 |
| SE18 | FA1 | 2 | Am7 | 1 | 180 | 5 |
| SE19 | FA1 | 2 | Am4 + Am1 | 1 | 180 | 5 |
| SE20 | FA6 | 2 | Am1 + Am2 | 0.5 + 0.5 | 180 | 5.5 |
| SE21 | FA6 | 2 | Am6 | 1 | 180 | 7 |
| SE22 | FA1 | 2 | Am8 | 1 | 180 | 5.5 |
| SE23 | FA1 | 2 | Am9 | 1 | 180 | 8 |
| SE24 | FA1 | 1.8 | Am1 + Am2 | 0.5 + 0.5 | 180 | 7.5 |
| SE25 | FA6 | 2 | Am2 | 1 | 180 | 8 |
| SE26 | FA7 | 2 | Am1 + Am2 | 0.5 + 0.5 | 180 | 6 |
| SE27 | FA8 | 2 | Am1 + Am2 | 0.5 + 0.5 | 180 | 7 |
| SE28 | FA9 | 2 | Am1 + Am2 | 0.5 + 0.5 | 180 | 6 |
| SE29 | FA1 | 3 | Am10 | 1 | 170 | 15 |

Note to Table 2a

In SE13 to SE17 the reaction was "cooked on" at significantly higher temperature and/or for longer to see how such more vigorous conditions affected the product.

Some properties of materials synthesised in Synthesis Examples SE1 to SE 29 are summarised in Table 1b below.

TABLE 1b

| SE No | AV [mg(KOH) · g−1] | TAV [mg(KOH) · g−1] | SAV [mg(KOH) · g−1] | SAP [mg(KOH) · $g^{-1}$] |
|---|---|---|---|---|
| SE1 | 2 | 25 | 17 | 78 |
| SE2 | 4 | 97 | 60 | 4 |
| SE3 | 5 | — | — | 161 |
| SE4 | 3 | 18 | 8 | 77 |
| SE5 | 4 | 79 | 22 | 6 |
| SE6 | 2 | 50 | — | — |
| SE7 | 2 | 51 | — | — |
| SE8 | 3 | 24 | — | — |
| SE9 | 2 | 51 | — | — |
| SE10 | 2 | 52 | — | — |
| SE11 | 2 | 133 | — | — |
| SE12 | 11 | 33 | — | — |
| SE13 | 3 | 163 | — | — |
| SE14 | — | 52 | — | — |
| SE15 | 18 | 8 | — | — |
| SE16 | 6 | 3 | — | — |
| SE17 | 4 | — | — | — |
| SE18 | 4 | 3 | — | — |
| SE19 | 3 | 96 | — | — |

TABLE 1b-continued

| SE No | AV [mg(KOH) · g−1] | TAV [mg(KOH) · g−1] | SAV [mg(KOH) · g−1] | SAP [mg(KOH) · $g^{-1}$] |
|---|---|---|---|---|
| SE20 | 2 | 66 | — | — |
| SE21 | 3 | 200 | — | — |
| SE22 | 5 | 292 | — | — |
| SE23 | 5 | 242 | — | — |
| SE24 | 1 | 70 | — | — |
| SE25 | 3 | 93 | — | — |
| SE26 | 2 | 60 | — | — |
| SE27 | 3 | 66 | — | — |
| SE28 | 2 | 59 | — | — |
| SE29 | 6 | — | — | — |

Note to Table 1b

In SE23 and SE24 calculation indicates that only 70 to 75% of the primary amino groups in the polyethylenimines have been amidated. The product Acid Value indicates the presence of free stearic acid at the end of the reaction suggesting that the residual primary amino groups are too sterically hindered to be readily reactive.

APPLICATIONS EXAMPLES

Various of the materials made in Synthesis Examples SE1 to SE3?? were tested for their effectiveness as conditioners in laundry cleaning.

Materials

The products of the Synthesis Examples are identified as the SE No. SE½a 1:1 blend of the products of Synthesis Examples SE1 and SE2

| | |
|---|---|
| Alcohol 8EO | $C_{13/15}$ alcohol 8 ethoxylate |
| LABS | linear alkyl benzene sulphonate (30% active) |
| SLES | sodium lauryl ether sulphate (30% active) |
| COFA | coconut fatty acid |
| NaOH | sodium hydroxide |
| TEA | triethanolamine |

Applications Example AE1

Aqueous liquid laundry 2-in-1 detergent formulations were made up including conditioners as follows:

| Material | role | amount (wt %) |
|---|---|---|
| Alcohol 8EO | non-ionic detergent surfactant | 10 |
| LABS | anionic detergent surfactant | 8 |
| SLES | anionic detergent surfactant | 10 |
| COFA | soap (when neutralised) | 8 |
| NaOH | builder/neutralising agent | 2.5 |
| SE no | conditioner | 1 |
| TEA | builder/neutralising agent | 1 |
| | water | to 100 |

The formulations were tested by addition to the test formulation and were assessed for how ling they remained stable as liquid formulations (in hours, h), their effectiveness in cleaning laundry and in conditioning the cleaned clothes was assessed using a panel of testers. All the products gave clean results i.e. substantially no difference on visual assessment from cleaning with detergent containing no fabric conditioner. The panel testing for fabric conditioning was based on comparison and preference choice between pairs of samples. The results were combined to produce an overall assessment expressed on a five point scale where 1=substantially no softening (i.e. the effect of using a detergent alone and no attempt to condition) to 5=very soft equivalent to using a current commercial fabric conditioner in a rinse cycle application. The conditioning results are set out in Tables AE1 and AE2 below, which includes (as AE1C.1) a rating for cloth washed using a Bold 2-in-1 detergent.

TABLE AE1

| AE No | SE No | Stability (h) | Conditioning |
|---|---|---|---|
| AEC1.1 | — | — | 2 |
| AE1.1 | SE1 | <24 | 3-4 |
| AE1.2 | SE2 | >>24 | 2-3 |
| AE1.3 | SE1/2a | >>24 | 3-4 |
| AE1.4 | SE3 | >>24 | 2-3 |
| AE1.5 | SE4 | >>24 | 2-3 |

Test data on formulations made up using the products of SE 6 to SE 29 are summarised in table AE2 below.

TABLE AE2

| | Formulation Description and Stability | | | | | | |
|---|---|---|---|---|---|---|---|
| | 24 hr | | 48 hr | | 72 hr | | |
| SE No | Appear | Stability | Appear | Stability | Appear | Stability | Cond. |
| SE6 | opaque | good | opaque | good | opaque | good | 3-4 |
| SE7 | opaque | good | opaque | good | opaque | good | 3 |
| SE8 | opaque | good | opaque | good | opaque | good | 3 |
| SE9 | clear | good | clear | good | clear | good | 2-3 |
| SE10 | opaque | good | opaque | good | opaque | good | 3-4 |
| SE11 | opaque | good | opaque | good | opaque | good | 2-3 |
| SE12 | opaque | good | opaque | good | opaque | good | 3-4 |
| SE13 | opaque | good | opaque | good | opaque | good | 3-4 |
| SE14 | visc gel | good | visc gel | good | visc gel | good | 3-4 |
| SE15 | grainy | good | grainy | good | grainy | good | 3-4 |
| SE16 | sl cloudy | good | clear | good | clear | good | 2-3 |
| SE17 | opaque | good | opaque | good | opaque | good | 2-3 |
| SE18 | clear | good | clear | good | clear | good | 3 |
| SE19 | opaque | good | opaque | good | opaque | good | 3-4 |
| SE20 | sl cloudy | good | clear | good | clear | good | 3 |
| SE21 | clear | good | clear | good | clear | good | 3-4 |
| SE22 | opaque | good | opaque | good | opaque | good | 3 |
| SE23 | opaque | good | opaque | good | opaque | good | 3 |
| SE24 | opaque | good | opaque | good | opaque | good | 3 |
| SE25 | clear | good | clear | good | clear | good | 2 |
| SE26 | opaque | good | opaque | good | opaque | good | 2-3 |
| SE27 | opaque | good | opaque | good | opaque | good | 3 |
| SE28 | opaque | good | opaque | good | opaque | good | 2-3 |
| SE29 | opaque | good | visc gel | good | visc gel | good | 2 |

The invention claimed is:

1. A method of cleaning and conditioning textiles, the method comprising:

i) contacting textiles during a wash cycle with a laundry cleaning and conditioning system comprising:

a) water;

b) at least one detergent surfactant, comprising at least one non-ionic detergent surfactant and at least one anionic detergent surfactant; and c) at least one non-ionic fatty amino-amide/ester fabric conditioner, comprising at least one compound having one or both of the following molecular groupings:

$$R^1CO—(X)—R^3—NR^2— \quad \text{or} \tag{Ia}$$

$$R^1C{=}(N)—R^3—N— \tag{Ib}$$

wherein:

$R^1$ represents a $C_9$ to $C_{23}$ hydrocarbyl group;

$R^2$ represents a H;

X represents —O— or —NH—; and $R^3$ independently represents $—(CH_2)_n—$, wherein n independently represents a value from 2 to 6; and ii) maintaining the contact so that the textiles are washed and conditioned.

2. A method as claimed in claim 1 wherein the at least one detergent surfactant and at least one non-ionic fatty amino-amide/ester fabric conditioner are present in a preformulated composition.

3. The method of claim 1, further comprising subsequently subjecting the washed and conditioned textiles to at least one rinse cycle.

4. A method as claimed in claim 3 which includes one rinse cycle.

5. The method of claim 1, wherein the at least one non-ionic fatty amino-amide/ester fabric conditioner comprises at least one compound represented by formula (IIa), (IIb), (IIc) and/or (IId):

$$R^1—CO—NH—R^3—NR^2—R^3—O_2C—R^1; \tag{IIa}$$

$$R^1—CO—NH—R^3—NR^2—R^3—NHCO—R^1; \tag{IIb}$$

$$R^1C{=}(N)—R^3—N—R^3—O_2C—R^1; \text{ or} \tag{IIc}$$

$$R^1C{=}(N)—R^3—N—R^3—NHCO—R^1; \tag{IId}$$

wherein $R^1$, $R^2$, and $R^3$, are independently represented as defined in claim 1.

6. A method as claimed in claim 1 wherein the at least one non-ionic fatty amino-amide/ester fabric conditioner further comprises at least one compound of the formula (IV):

$$R^7—N-[(AO)_m—R^8]_2 \tag{IV}$$

where $R^7$ is a hydrocarbyl, particularly a fatty hydrocarbyl, particularly alkyl, group;

AO is an alkyleneoxy, particularly ethyleneoxy, group;

m is an average value of 1 to 10; and one group $R^6$ is a group $COR^9$ and the other is H or a group $COR^9$, where each group $R^9$ is independently a $C_1$ to $C_{23}$ hydrocarbyl group;

where in at least one group $R^7$ or $R^9$ is or includes a fatty hydrocarbyl group.

7. The method of claim 1, wherein the at least one non-ionic detergent surfactant comprises at least one alkylene oxide derivative of one or more of alcohols, amines, alkanolamides and alkylphenols and/or amine oxide based detergent surfactant.

8. The method of claim 1, wherein the non-ionic detergent surfactant comprises from 0.1 to 50%, by weight of the overall formulation.

9. The method of claim 1, wherein the at least one anionic detergent surfactant comprises at least one of natural or synthetic soaps, alkylbenzene or olefin sulphonates, alcohol sulphates, and/or alcohol alkoxylate sulphates.

10. The method of claim 1, wherein the anionic detergent surfactant comprises from 0.1 to 50%, by weight of the overall formulation.

11. The method of claim 1, wherein the laundry cleaning and conditioning system further comprises at least one detergency builder.

12. A method as claimed in claim 11 wherein the at least one detergency builder includes at least one of alkali metal, usually sodium and/or potassium, salts such as phosphates, condensed phosphates; carbonates; silicates; zeolites; organic compounds such as sodium carboxymethylcellulose; nitrilotriacetic acid and its water soluble salts; and hydroxycarboxylic acids having 2 to 6 —COOH groups and 1 to 5 —OH groups or their water soluble salts.

13. The method of claim 11, wherein the detergency builder comprises from 2 to 90%, by weight of the overall formulation.

14. A method as claimed in claim 1 wherein the temperature of the laundry cleaning system is from 25 to 60° C.

15. A method as claimed in claim 1 wherein the pH of the laundry cleaning and conditioning system is from 8 to 10.

16. A laundry detergent and fabric conditioning formulation comprising:

a) at least one detergent surfactant, comprising at least one non-ionic detergent surfactant and at least one anionic detergent surfactant;

b) at least one non-ionic fatty amino-amide/ester fabric conditioner, comprising at least one compound having one or both of the following molecular groupings:

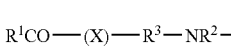

(Ia)

or

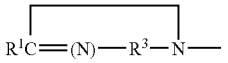

(Ib)

wherein:

$R^1$ represents a $C_9$ to $C_{23}$ hydrocarbyl group;

$R^2$ represents a H;

X represents —O— or —NH—; and $R^3$ independently represents $—(CH_2)_n—$ wherein n independently represents a value from 2 to 6; and c) at least one detergency builder.

17. The formulation of claim 16, wherein the at least one non-ionic fatty amino-amide/ester fabric conditioner comprises at least one compound represented by formula (IIa), (IIb), (IIc) and/or (IId):

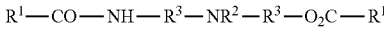

(IIa)

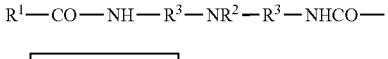

(IIb)

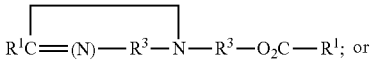

(IIc)

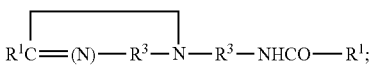

(IId)

wherein $R^1$, $R^2$, and $R^3$, are independently represented as defined in claim 18.

18. A formulation as claimed in claim 17 in the form of a powder, tablets, a liquid or packaged liquid.

19. A formulation as claimed in claim 17 which when dispersed or dissolved in water at laundry cleaning concentration generates a pH of from 8 to 10.

20. A formulation as claimed in claim 16 wherein the at least one non-ionic fatty amino-amide/ester fabric conditioner further comprises at least one compound of the formula (III):

$$[R^4\text{-}R^5]_3—N \quad \text{(III)}$$

where each group $R^4$ is independently HO—, or $R^6CO_2$—; where $R^6$ is hydrocarbyl, particularly a $C_1$ to $C_{24}$, group, with the molecule including at least one and desirably two groups $R^6$ being fatty hydrocarbyl, particularly $C_9$ to $C_{23}$, group(s); and each $R^5$ is independently a $C_2$ to $C_6$ alkylene group, particularly of the formula $—(CH_2)_p—$ where each p is independently from 2 to 6, usually 2 or 3 and generally 2.

21. The formulation of claim 16, wherein the at least one non-ionic fatty amino-amide/ester fabric conditioner is the reaction product of a precursor amine or hydroxy amine and at least one fatty acid.

22. The formulation of claim 16, wherein the molar ratio of fatty acid to amine is from 1:1 to 3:1.

23. A formulation as claimed in claim 16 wherein the at least one non-ionic fatty amino-amide/ester fabric conditioner further comprises at least one compound of the formula (IV):

$$R^7—N\text{-}[(AO)_m—R^8]_2 \quad \text{(IV)}$$

where $R^7$ is a hydrocarbyl, particularly a fatty hydrocarbyl, particularly alkyl, group;

AO is an alkyleneoxy, particularly ethyleneoxy, group;

m is an average value of 1 to 10; and one group $R^6$ is a group $COR^9$ and the other is H or a group $COR^9$, where each group $R^9$ is independently a $C_1$ to $C_{23}$ hydrocarbyl group;

wherein at least one group $R^7$ or $R^9$ is or includes a fatty hydrocarbyl group.

24. The formulation of claim 16, wherein the at least one non-ionic detergent surfactant comprises at least one alkylene oxide derivative of one or more of alcohols, amines, alkanolamides and alkylphenols and/or amine oxide based detergent surfactant.

25. The formulation of claim 16, wherein the non-ionic detergent surfactant comprises from 0.1 to 50%, by weight of the overall formulation.

26. The formulation of claim 16, wherein the at least one anionic detergent surfactant comprises at least one of natural or synthetic soaps, alkylbenzene or olefin sulphonates, alcohol sulphates, and/or alcohol alkoxylate sulphates.

27. The formulation of claim 16, wherein the anionic detergent surfactant comprises from 0.1 to 50%, by weight of the overall formulation.

28. The formulation of claim 16, wherein the at least one detergency builder includes at least one alkali metal, usually sodium and/or potassium, salts such as phosphates, condensed phosphates; carbonates; silicates; zeolites; organic compounds such as sodium carboxymethylcellulose; nitrilotriacetic acid and its water soluble salts; and hydroxycarboxylic acids having 2 to 6 —COOH groups and 1 to 5 —OH groups or their water soluble salts.

29. The formulation of claim 16, wherein the detergency builder comprises from 2 to 90%, by weight of the overall formulation.

30. The formulation of claim 16, further comprising one or more fluorescer, antifoam, bleach, bleach activator, enzyme, fragrance, antiredeposition agent, opacifier, preservative and/or thickener.

31. A laundry detergent and fabric conditioning formulation according to claim 16, wherein the formulation is transparent.

* * * * *

UNITED STATES PATENT AND TRADEMARK OFFICE

CERTIFICATE OF CORRECTION

PATENT NO. : 8,470,761 B2
APPLICATION NO. : 12/734322
DATED : June 25, 2013
INVENTOR(S) : Michael E. Calvert It is certified that error appears in the above-identified patent and that said Letters Patent is hereby corrected as shown below:

In the Claims

Column 18, line 48, that portion of the claim reading "$R^{6}$" should be changed to --$R^{8}$--.

Column 20, line 40, that portion of the claim reading "$R^{6}$" should be changed to --$R^{8}$--.

Signed and Sealed this
Seventeenth Day of June, 2014

Michelle K. Lee

Michelle K. Lee
*Deputy Director of the United States Patent and Trademark Office*